US005932028A

United States Patent [19]

Carrie et al.

[11] Patent Number: 5,932,028

[45] Date of Patent: Aug. 3, 1999

[54] PAINT ROLLER CLEANER ASSEMBLY

[76] Inventors: Edward A. Carrie, 2233 S. Highland Ave., Lombard, Ill. 60148; Lois M-C Bez, 3569 Barberry Cir., Wixom; Robert L. Carrie, Jr., 6538 Carriage Hills Dr., Canton, both of Mich. 48187

[21] Appl. No.: 08/986,083

[22] Filed: Dec. 5, 1997

[51] Int. Cl.[6] ..... B08B 3/02

[52] U.S. Cl. ..... 134/32; 134/33; 134/42; 134/155; 134/138; 134/900

[58] Field of Search ..... 134/155, 186, 134/138, 900, 201, 32, 33, 38, 42; 68/213

[56] References Cited

U.S. PATENT DOCUMENTS

| | | | |
|---|---|---|---|
| 3,421,527 | 1/1969 | Dettman | 134/900 |
| 3,431,574 | 3/1969 | Mathieu | 134/900 |
| 3,587,599 | 6/1971 | Bywater . | |
| 3,688,785 | 9/1972 | Stevens et al. . | |
| 3,886,960 | 6/1975 | Krueger . | |
| 3,897,797 | 8/1975 | Wright et al. . | |
| 4,126,484 | 11/1978 | Monteiro . | |
| 4,142,540 | 3/1979 | Vegiard . | |
| 4,155,230 | 5/1979 | Lacher, Jr. . | |
| 4,294,272 | 10/1981 | Klaiber . | |
| 4,377,175 | 3/1983 | Fritz . | |
| 4,380,478 | 4/1983 | Cooney . | |
| 4,641,673 | 2/1987 | Conley et al. . | |
| 4,672,987 | 6/1987 | Brandt . | |
| 4,700,728 | 10/1987 | Patterson . | |
| 4,711,258 | 12/1987 | Rossborough et al. . | |
| 4,765,354 | 8/1988 | Thatcher et al. . | |
| 4,766,755 | 8/1988 | Allen . | |
| 4,778,534 | 10/1988 | Nell . | |
| 4,809,722 | 3/1989 | Pennise . | |
| 4,811,749 | 3/1989 | Dixon | 134/900 |
| 4,832,066 | 5/1989 | Shipman . | |
| 4,957,127 | 9/1990 | Kostopoulos . | |
| 5,050,626 | 9/1991 | Brockage et al. . | |
| 5,086,796 | 2/1992 | Bailey | 134/900 |
| 5,095,928 | 3/1992 | Phipps . | |
| 5,111,834 | 5/1992 | O'Brien . | |
| 5,402,808 | 4/1995 | Wallis et al. | 134/900 |
| 5,409,027 | 4/1995 | Glunt . | |
| 5,413,133 | 5/1995 | Russell . | |
| 5,544,668 | 8/1996 | Dollar | 134/900 |
| 5,797,410 | 8/1998 | Gates | 134/900 |

*Primary Examiner*—Frankie L. Stinson
*Attorney, Agent, or Firm*—Harness, Dickey & Pierce, P.L.C.

[57] ABSTRACT

A paint roller cleaner assembly includes a clear cylindrical tube having a cap on one end for receiving a fluid supply line. Located at the other end of the tube is a connection means for detachably connecting a base having a plurality of legs for maintaining the paint roller cleaning assembly in an upright position. A spacer offsets the end of the paint roller from the inlet and outlet ports to ensure proper cleaning of the roller. The legs can be moved to accommodate the user to maintain the paint roller cleaner in an upright position.

19 Claims, 5 Drawing Sheets

PAINT ROLLER CLEANER ASSEMBLY

FIELD OF THE INVENTION

The present invention relates generally to a paint roller cleaner assembly and, more particularly, to an improved paint roller cleaner assembly which is operable to receive a standard paint roller and its applicator, and in an upright manner clean the applicator efficiently with pressurized fluid while minimizing cleanup and providing the operator with a visual indication of when the applicator is clean.

BACKGROUND AND SUMMARY OF THE INVENTION

It is well understood in the painting industry and in the home repair industry to use paint rollers to apply paint to walls, ceilings, or other surfaces within a home or building, in order to provide the desired paint finish. The paint roller generally includes an applicator with an inner tube and an outer nap that is secured to the tube. Naps vary in texture and thickness and are designed to absorb paint which is subsequently applied to the desired surface. The typical paint roller further includes an elongated cylindrical metal frame or spindle that slides into the inner tube of the paint roller applicator and a handle secured to one end of the spindle. The cylindrical frame rotates about an axis on the handle to provide rotation of the nap and enhance application of the paint to the desired surface.

Cleaning the applicator is sometimes the most difficult portion of the painting process because it is messy and time consuming. Large commercial size applicators are expensive, thus making it desirable to reuse them. Various procedures have been employed to clean applicators, including placing the applicator in a pail of cleaning solution and swirling it around until the nap is clean. This method often results in an improper cleaning of the nap which causes paint to build up on the surface of the nap. If this occurs, the build up results in imperfections on the surface of the nap. These imperfections can be seen on the painted surface when the applicator is subsequently used. Further, this method of cleaning an applicator becomes very messy because the operator must physically hold the paint-filled applicator while it is being cleaned.

Another method of cleaning a paint roller applicator includes placing the paint roller applicator within a container that is surrounded by a plurality of spray nozzles that impinge high pressurized liquid onto the surface of the nap. Devices used to practice this method generally require numerous components and prove to be quite expensive.

Other methods of cleaning paint roller applicators include inserting the applicator within a device, applying pressurized fluid to one end of the device and then allowing the pressurized fluid to cleanse the nap. Devices utilizing this method have been found to insufficiently clean the nap and are also difficult to maneuver in tight spaces, for example, when a person is cleaning at the kitchen sink and the paint roller cleaning device tends to keep falling over. Further, if a person attempts to use one of these conventional devices near an outside water tap, it will tend to fall over and the dirty pressurized fluid will be directed onto undesirable surfaces, such as the side of a house. Moreover, with these devices, it is difficult to ascertain when the applicator is thoroughly clean.

Alternatively, a person could throw the applicator away, but because painting contractors and homeowners desire to reuse applicators for numerous projects, this method can become costly to the operator. Accordingly, it is desirable to provide a paint roller applicator cleaner structure that maximizes the life of the applicator, allows the operator to set the cleaner assembly upright over a drain and turn the water on and let the cleaner assembly clean the applicator without human intervention. It is further desirable to provide a paint roller cleaner assembly that provides a visual indication of when the applicator is substantially clean. It is also desirable to provide a paint roller cleaner assembly that allows users to clean applicators as the applicator for a large roller may vary in design.

Accordingly, it is further desirable to provide a paint roller cleaner assembly that minimizes the number of components used in the assembly, significantly cleans the applicator nap so that it can be repeatedly reused, is connectable to commonly used water supply sources, for example a water hose, and is operable to stand upright in various environments with minimum human intervention so that a person does not have to attend to the cleaning device while the cleaning process ensues. It is further desirable to provide a paint roller cleaner device that easily indicates to the operator when the paint roller cleaner applicator is clean.

It is an object of the present invention to provide a paint roller cleaner assembly that overcomes the problems associated with conventional paint roller cleaners. Such paint roller cleaner and method of operating the same should be simple in design and should allow an operator to clean various sizes of applicators in various work environments.

A first preferred form of the present invention provides a paint roller cleaner assembly having a cylindrical structure operable to receive a paint roller applicator, the cylindrical structure having a central longitudinal axis and an opening for receiving a handle. A cap covers one end of the cylindrical structure and a fluid inlet is located within the cap for receiving pressurized fluid for cleansing the applicator. Connected to a distal end of the cylindrical structure is a detachable base having a plurality of legs and a centrally located outlet port that is operable to provide fluid back pressure. The cylindrical structure is operable to provide a visual indication when the applicator is clean.

A second preferred form of the present invention includes a paint roller cleaner device comprising a cylindrical tube that is operable to receive a paint roller applicator that needs to be cleaned. A cap covers one end of the cylindrical tube and has a fluid inlet operable to receive the pressurized fluid for washing the paint roller applicator. A detachable base is connectable to the tube and has a plurality of outwardly extending legs and a centrally located outlet port.

A third preferred form of the present invention provides a method of cleaning a paint roller comprising the steps of providing a paint roller, a cylindrical structure, and a base. The cylindrical structure is connected to a fluid supply and a paint applicator that needs to be cleaned is inserted within the cylindrical structure. The applicator is spaced a predetermined distance from a fluid inlet opening and an outlet opening and the base is then connected to the cylindrical structure. The applicator is then flushed with pressurized fluid, and an operator visually inspects the flushing of the applicator and turns off the pressurized fluid when the applicator has been cleaned to a predetermined condition.

Other forms of the present invention include utilizing a variety of connecting means to selectively attach the base to the cylindrical structure.

From the following specification taken in conjunction with the accompanying drawings and the appended claims, other objects, features and advantages of the present invention will become apparent to those skilled in the art.

DETAILED DESCRIPTION OF THE PREFERRED EMBODIMENTS

Figure 1:
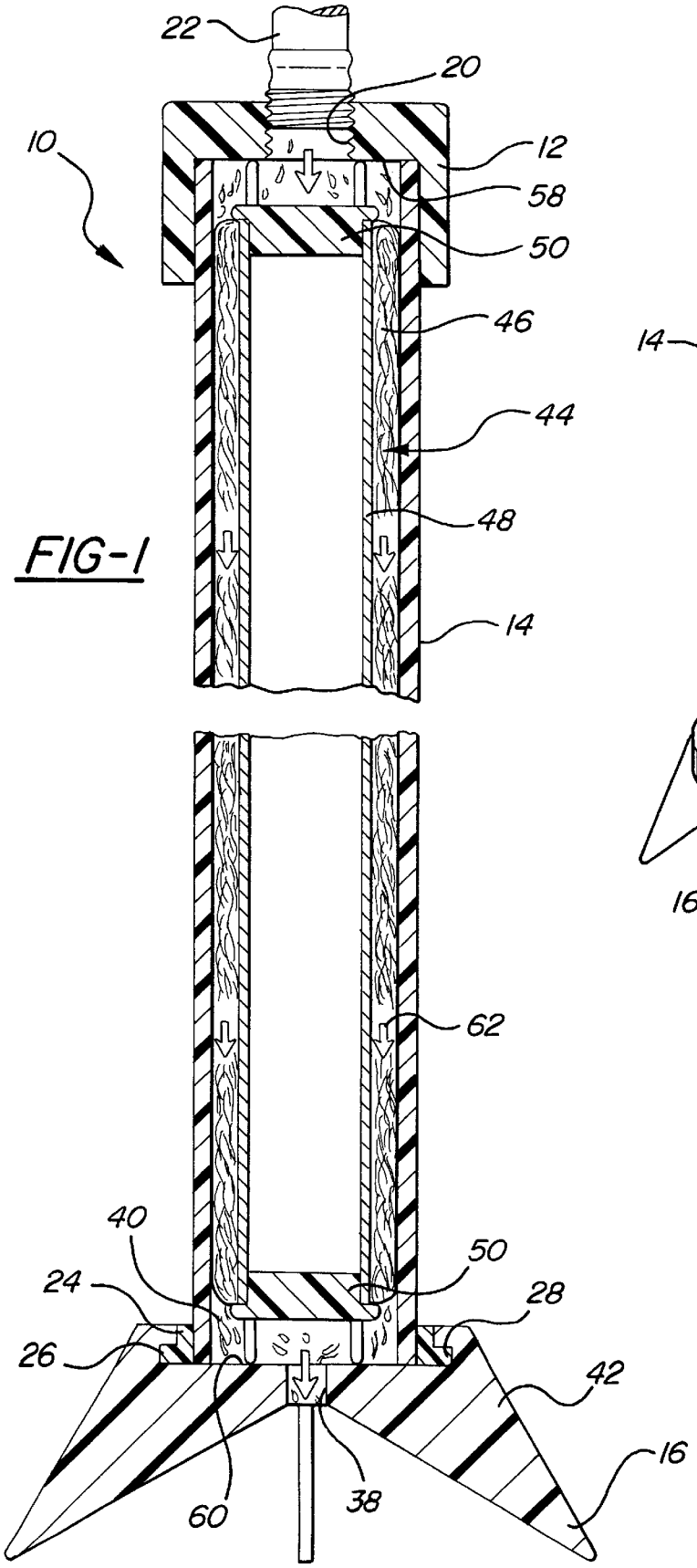
FIG. 1 is a side elevational view of the paint roller cleaner assembly.
Figure 2:
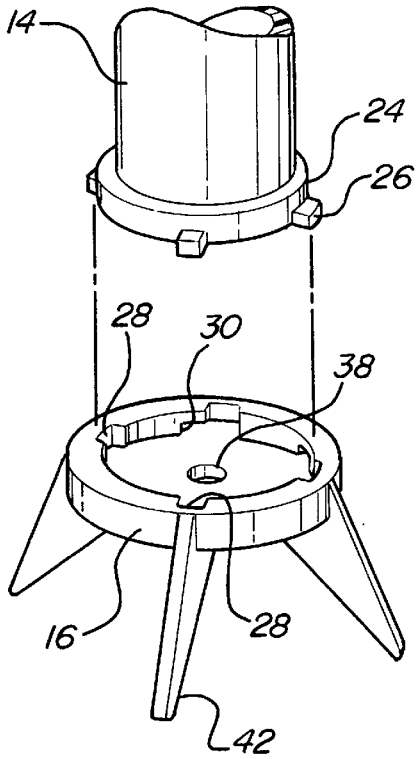
FIG. 2 is a fragmented exploded perspective view of the paint roller cleaner assembly of the present invention, illustrating the slot-and-ring type method of connecting the tube to the base.

As illustrated in FIGS. 1 and 2, a novel paint roller cleaner assembly 10 is illustrated which includes a cap 12, a cylindrically-shaped structure or tube 14, and a detachable base 16. The cap 12 has a downturned portion 18 that is operable to receive one end of the tube 14. The cap 12 and the tube 14 can be connected by conventional means, including, but not limited to adhesives or by threading the two together. The top portion of the cap 12 has internal threads 20 that receive a fluid supply hose 22. It will be appreciated that fluid, as used herein, can be any type of cleansing agent, including, but not limited to, water or solvents.

At the distal end of the tube 14, a ring 24 having L-shaped portions 26 is secured to the tube 14 preferably by an adhesive. A plurality of L-shaped portions or tabs 26 are located around the periphery of the ring 24 and mate with corresponding recesses 28 located within the base 16. A stop 30 limits the travel of the tube 14 as it is rotated relative to the base 16.

The base 16 further has a centrally located outlet port 38 for allowing pressurized fluid to exit the tube 14. The outlet port 38 is of sufficient diameter to create a back pressure within the cavity 40 of the tube 14. The base 16 further has a plurality of downwardly extending legs 42 for maintaining stability of the paint roller cleaner assembly 10. The legs allow an operator to plant the assembly 10 on top of the ground or perhaps centrally located over the drain in a wash basin. The cap 12, tube 14, and base 16 are preferably made of a plastic material. The tube 14 is further preferably made of a transparent material, for example, clear PVC. This allows the operator to visually monitor the progress of the cleaning. This visual inspection further saves money and resources because the operator will promptly know when the cleaning process is complete.

Figure 7:
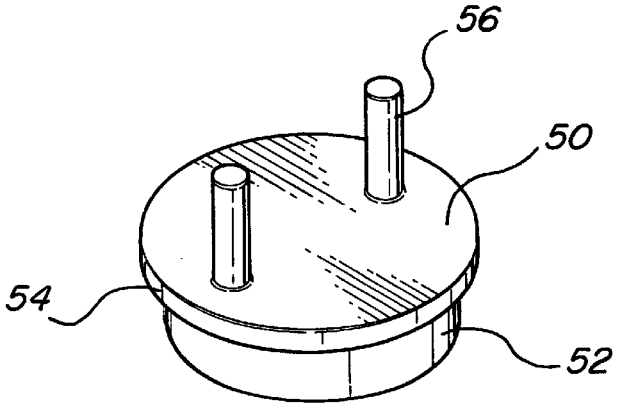
FIG. 7 is a perspective view of the spacer that is depicted in FIG. 1.

Located within the tube 14 is a paint roller 44 having a nap 46 made of interwoven material that is secured to a cylindrical sleeve 48. Located at each end of the roller 44 are plugs or spacers 50 (see FIG. 7). Each spacer 50 has a reduced diameter portion 52 that fits within the sleeve 48 and a larger annular portion 54 that closes the end of the roller so that fluid does not enter into the internal cavity of the sleeve 48. A plurality of protrusions 56 extend from the annular portion 54 and contact end 58 of a cap to ensure a proper offset. The spacer 50 helps direct the pressurized fluid in a path to the nap 46 that otherwise may not be obtained if the roller 44 was not distanced from the end 58. The spacer 50 on the end connected to the base 16 maintains the distance of the roller 44 relative to the flat 60 of the base. Without the spacer at this location, the pressurized fluid would tend to force the roller 44 against the flat 60, thus inhibiting the flow of fluid to the outlet port 38. Fluid flow adjacent the spacer 50 in the cavity 40 is turbulent which enhances the cleaning process by agitating the nap.

The present invention can be operated by first detaching the base 16 from the tube 14 by rotating it in the desired direction. Next, the roller 44 to be cleaned would be detached from its handle (not shown) and a spacer 50 would be located within each end. The roller 44 is now inserted within tube 14, fluid supply line 22 is then connected to the cap 12 and base 16 is secured to the tube 14 by aligning the L-shaped portions or tabs 26 with the corresponding recesses 28. The base and tube 14 is rotated to a locked position and the tube is then placed upright. Pressurized fluid then enters through the cap 12, is deflected by the spacer 50, and directed to and through the nap 46. The pressurized fluid is directed along the path of least resistance in the direction of arrows 62 to the outlet port 38. As the cleaning process continues, the operator will be able to visually inspect the clear tube 14 and monitor the cleaning process. When the nap 46 is cleaned to the desired condition, fluid flow is stopped. The base 16 can then be detached from the tube 14 in a manner opposite to the steps used to attach the same. The fluid source is then turned back on, thus facing the roller 44 out of the tube 16.

Figure 3:
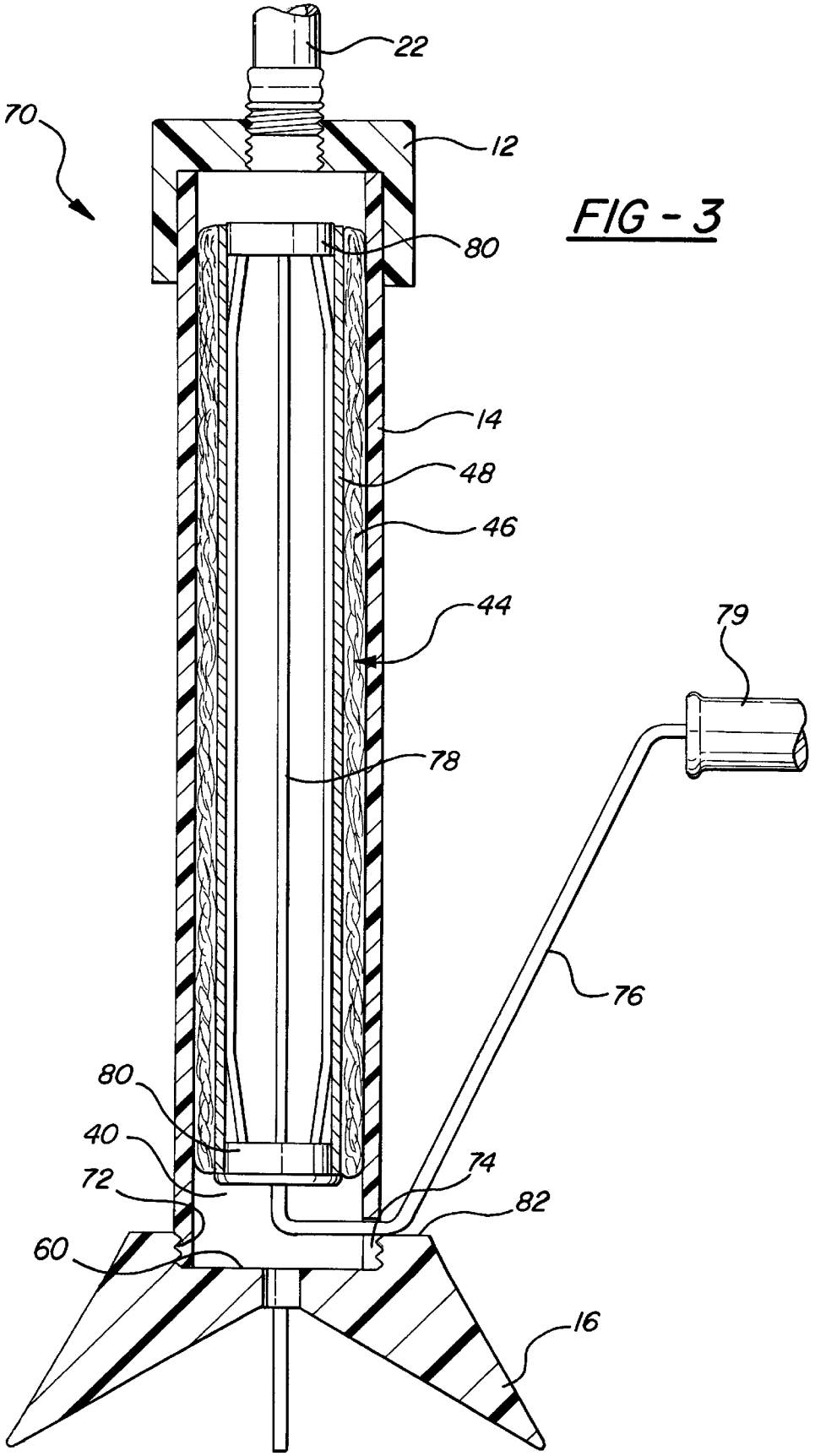
FIG. 3 is a side elevational view of an alternative paint roller cleaner assembly, illustrating a threaded tube-to-base type connection.

FIG. 3 represents an alternative paint roller cleaner assembly 70. Where possible, like reference numbers will be used to discuss the various embodiments therein. The alternative paint roller cleaner assembly 70 includes a cap 12, a tube 14, and a base 16. The tube 14, however, has external threads 72 at a distal end that engage female threads in the base 16. The tube 14 further has a slot 74 extending parallel to a longitudinal axis of the tube. The slot 74 provides a clearance for metal support frame 76. A conventional spindle 78 is secured to the metal support frame 76 for assisting the painter during painting. The spindle 78 slidably receives roller 44 and end caps 80 provide deflection means for directing the pressurized fluid to the nap 46.

To use the paint roller cleaner assembly 70, the supply hose 22 is secured to the cap 12 and the base 16 is detached from the tube 14. Next, the paint roller 44 to be cleaned is kept on the paint roller spindle 78 and the entire unit is slid into cavity 40. The metal support frame 76 is rotated so that it is received within slot 74. Base 16 can now be threaded onto tube 14 until the top edge 82 of the base engages a horizontal section of the metal support frame 76. This built-in spacer provides sufficient clearance between the flat 60 and the end of the roller 44 to allow fluid to exit cavity 40. Pressurized fluid is then introduced into the tube 14 by supply hose 22 and the operator monitors the cleaning phase until nap 46 is sufficiently clean. Once cleaned, fluid flow is terminated, base 16 is detached, and the cleaned roller 44 is removed.

Figure 4:
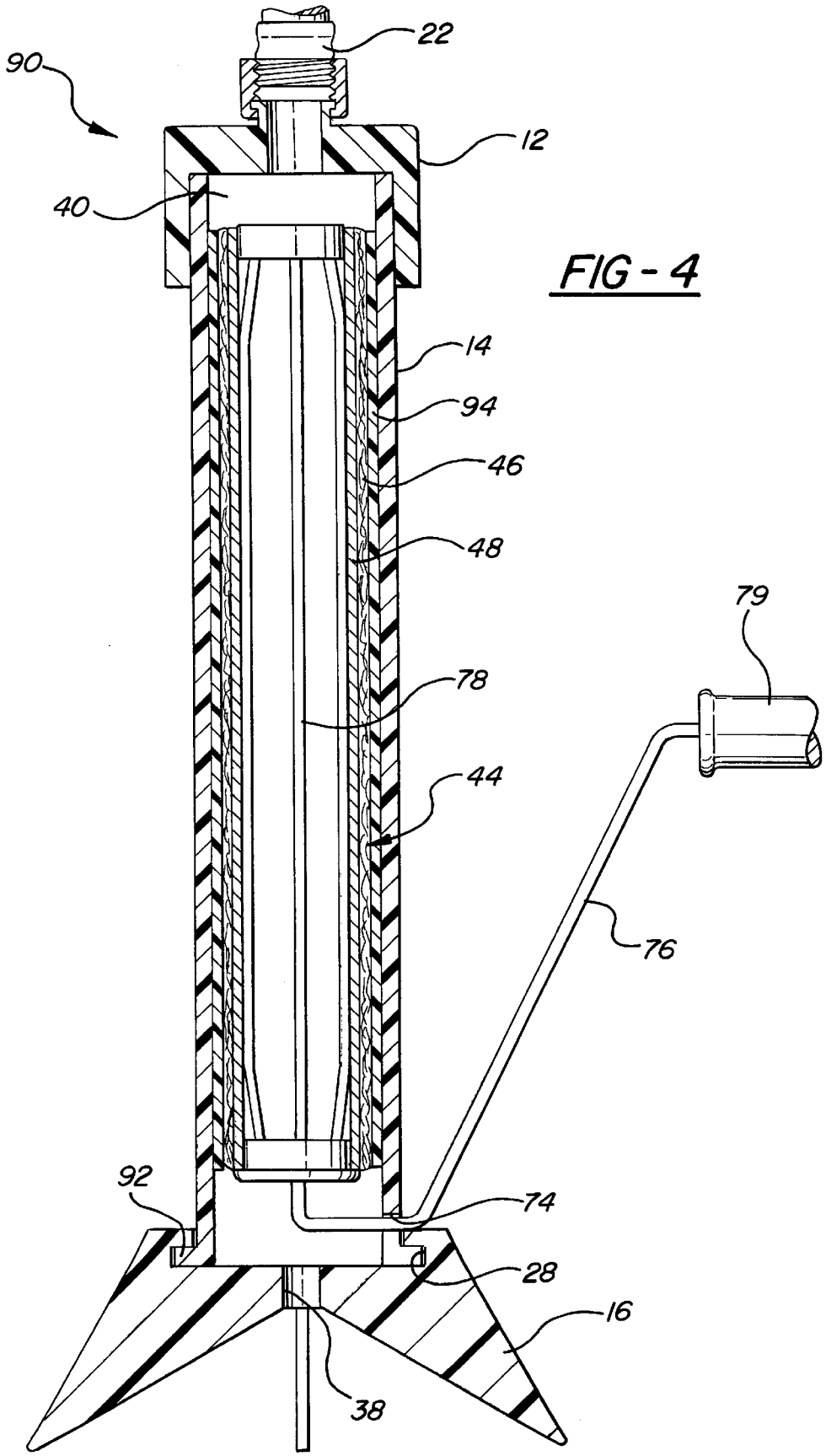
FIG. 4 is a side elevational view of an alternative paint roller cleaner assembly, illustrating a removable sleeve and a tab-and-slot type method of connecting the tube to the base.

With reference to FIG. 4, an alternative paint roller cleaner assembly 90 is disclosed having a cap 12, a tube 14, and a base 16. Integrally molded at the bottom of the tube 14 is a plurality of L-shaped tabs 92 that engage corresponding recesses 28 in the base 16 in a manner similar to that disclosed in the discussion pertaining to FIG. 1. The paint roller cleaner assembly 90 further includes a sleeve 94 that can be inserted into tube 14. The sleeve 94 is used when the size of the nap 46 is reduced in size. In these instances, the sleeve 94 occupies a space between the nap 46 and the inner diameter of the tube 14 sufficiently so that the nap 46 is snugly fit into the cavity 40. The sleeve 94 is preferably made of a plastic material to enhance visibility during the cleaning step.

To operate the paint roller cleaner 90, the fluid supply is connected to the cap 12. The sleeve 94 is now inserted over the nap 46 and the roller 44 can be slid within the tube 14. Alternatively, the sleeve 94 could be slid into the tube 14 first and the roller 44 then inserted. The metal support frame 76 is then positioned with the slot 74 and the base 16 is then locked into place. The cleaner 90 is placed upright and pressurized fluid is then applied to the nap 46 and the paint, or other material on the nap to be removed, is flushed out the outlet port 38. The cleaning process continues until the nap 46 is cleaned to a desired state. The base 16 is then rotated and detached from the tube 14 and handle 79 is pulled to remove the roller 44 from the tube 14. The sleeve 94 has sufficient clearance relative to the tube 14 so that the sleeve 94 slides out of the tube when the roller 44 is removed.

Figure 5:
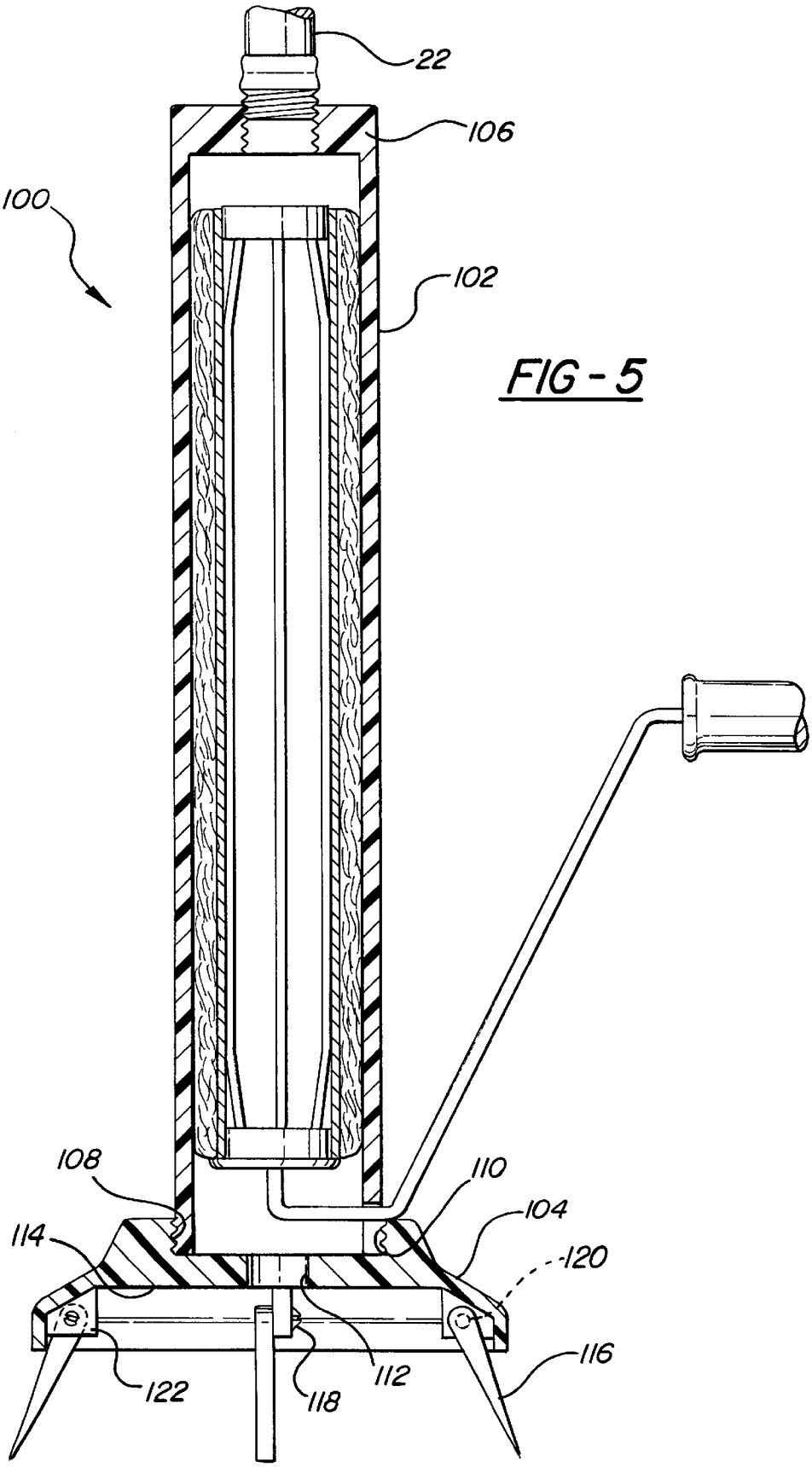
FIG. 5 is an alternative paint roller cleaner assembly, illustrating a base with articulating legs.

FIG. 5 represents an alternative paint roller cleaner assembly 100 that includes a cylindrically-shaped tube 102 and a base 104. The tube 102 has an integrally-formed cap 106 with internal threads for receiving a fluid supply line 22. The distal end of tube 102 has threads 108 and that engage a threaded bore 110 of the base 104.

Figure 6:
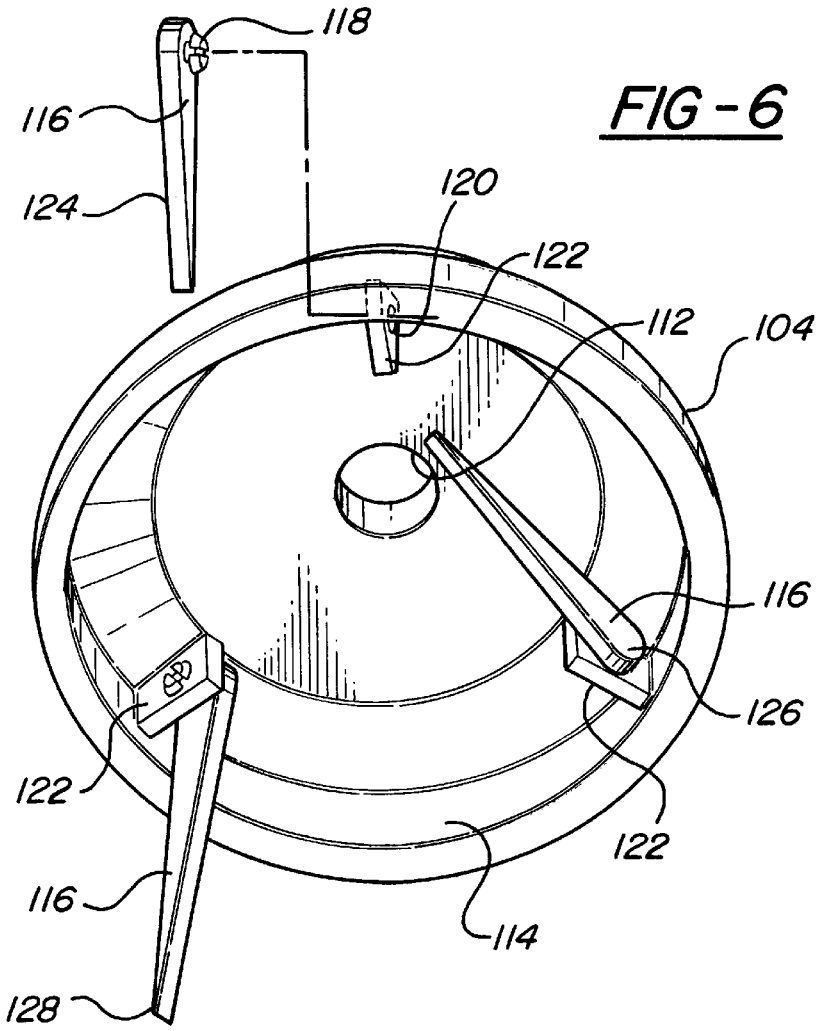
FIG. 6 is a bottom perspective view of the FIG. 5 paint roller cleaner assembly, illustrating the various positions of the legs.

The base 104 has an outlet 112 that opens up into an internal cavity 114. A plurality of articulating legs 116 are located within the cavity 114 to allow an operator to selectively position the legs 116 to an extended position or to a retracted position (See FIG. 6). Each leg 116 has a slotted collapsible peg 118 that is operable to be received within a hole 120 located within a flange 122. It is preferred that each such flange 122 is integrally molded to the base 104. Each peg 118 can be detached from the base 104 as shown in position 124, move to a retracted position as shown in position 126, or move to an extended position as shown in position 128. Such flexibility allows the operator to extend the legs 116 so that the paint roller cleaner assembly 100 can be maintained in an upright position when being used outside. For example, the legs 116 could be planted into the ground to hold the assembly 100 in an upright position. Alternatively, the legs 116 could be moved to their retracted position 126 when it is desired to use the paint roller cleaner assembly 100 in a wash basin. The legs 116 are preferably made of plastic and the tube 102 is preferably made of plastic material to allow the operator to visually inspect the cleaning process.

In operation, the paint roller cleaner assembly 100 operates in substantially the same method as previously described herein, and thus, no further discussion will be presented.

The foregoing discussion discloses and describes merely exemplary embodiments of the present invention. One skilled in the art will readily recognize from such discussion and from the accompanying drawings and claims, that various changes, modifications, and variations can be made therein without departing from the spirit and scope of the invention as defined in the following claims.

What is claimed is:

1. A paint roller cleaner device comprising:

a cylindrical tube operable to receive a paint roller applicator, the tube having a longitudinal axis;

a cap covering one end of the tube, the cap having an inlet to receive fluid for washing the paint roller;

a detachable base connectable to another end of the tube, said base having an internal cavity, a plurality of legs retractable within the cavity, and a centrally located outlet port.

2. The paint roller cleaner device claimed in claim 1 further comprising a spacer enclosing one end of the paint roller and offsetting an end of the roller from the inlet of the cap.

3. The paint roller cleaner device as claimed in claim 1 further comprising a collar surrounding the tube, the collar having protrusions that engage a recess in the base.

4. The paint roller cleaner device as claimed in claim 1, wherein the tube is made of a substantially clear material.

5. The paint roller cleaner device as claimed in claim 1, wherein there are at least three legs, each leg positionable to a retracted position and an outwardly extended position.

6. The paint roller cleaner device as claimed in claim 1, wherein the tube has threads and is operable to be threaded to the base.

7. The paint roller cleaner device as claimed in claim 1, wherein the tube has a flange located at one end, the base having a recess for receiving the flange, the tube and base can be selectively locked together.

8. The paint roller cleaner device as claimed in claim 1 wherein the applicator has a nap, the nap being fit snug against an inner diameter of the tube.

9. The paint roller cleaner device as claimed in claim 1, wherein the tube has an opening for receiving a handle, the handle has a first portion that extends from the applicator in a direction parallel to the longitudinal axis and has a second portion that extends in a direction normal to the longitudinal axis, the second portion resting against the base to offset the paint roller applicator from the outlet port.

10. The paint roller cleaner device as claimed in claim 1, wherein the legs are selectively positionable to a desired position.

11. A paint roller cleaner assembly comprising:

a cylindrical tube with an inlet fitting on one end and a first connecting member on the other end, the tube being operable to receive a paint roller having a handle; and a base having a second connecting member that is operable to engage the first connecting member to selectively connect the tube and base together, the base further having a plurality of legs for maintaining the paint roller cleaner in a substantially upright position, wherein the tube has a slot near the first connecting member, the slot being operable to receive the handle.

12. The paint roller cleaner assembly as claimed in claim 11, further comprising a sleeve located adjacent and within the cylindrical tube.

13. The paint roller cleaner assembly as claimed in claim 11, wherein the base includes a back pressure member for restricting fluid flow.

14. The paint roller cleaner assembly as claimed in claim 11, wherein the base includes an outlet passage.

15. The paint roller cleaner assembly as claimed in claim 11, wherein the cylindrical tube has an opening for a handle of a paint roller to extend therethrough.

16. The paint roller cleaner assembly as claimed in claim 11, further comprising a cap located at one end of the cylindrical tube, the inlet fitting being integral with the cap.

17. The paint roller cleaner assembly as claimed in claim 11, further comprising a spacer located within the cylindrical tube and positioned between the paint roller and the inlet fitting.

18. A method of cleaning a paint roller comprising:

providing a paint roller having an applicator located on a rolling device;

providing a cylindrical structure that is operable to receive the applicator, the structure having an end with a fluid inlet opening, the structure having walls made of clear material;

providing a base to support the cylindrical structure, the base having a fluid outlet;

connecting the structure to a pressurized fluid supply;

inserting the applicator within the structure;

spacing the applicator a predetermined distance from the fluid inlet opening;

attaching the base to the structure;

flushing the applicator with pressurized fluid;

visually inspecting the structure during the flushing step to monitor the on-going cleaning of the applicator; and continuing the flushing step until the applicator is cleaned to a desired state.

19. The method of cleaning a paint roller as claimed in claim 18 further comprising the step of inserting a sleeve between the applicator and the cylindrical structure to maintain sufficient fluid pressure on the applicator.

* * * * *